US010316380B2

(12) United States Patent
Roy et al.

(10) Patent No.: US 10,316,380 B2
(45) Date of Patent: Jun. 11, 2019

(54) THERMO-MECHANICAL TREATMENT OF MATERIALS

(71) Applicant: SCHLUMBERGER TECHNOLOGY CORPORATION, Sugar Land, TX (US)

(72) Inventors: Indranil Roy, Sugar Land, TX (US); Rashmi Bhavsar, Houston, TX (US)

(73) Assignee: SCHLUMBERGER TECHNOLOG CORPORATION, Sugar Land, TX (US)

( * ) Notice: Subject to any disclaimer, the term of this patent is extended or adjusted under 35 U.S.C. 154(b) by 1075 days.

(21) Appl. No.: 14/231,284

(22) Filed: Mar. 31, 2014

(65) Prior Publication Data

US 2014/0294651 A1 Oct. 2, 2014

Related U.S. Application Data

(60) Provisional application No. 61/806,781, filed on Mar. 29, 2013.

(51) Int. Cl.
*C21D 8/00* (2006.01)
*C22F 1/10* (2006.01)
(Continued)

(52) U.S. Cl.
CPC ..... *C21D 8/00* (2013.01); *B22F 3/14* (2013.01); *C22F 1/10* (2013.01); *B22F 5/12* (2013.01);
(Continued)

(58) Field of Classification Search
CPC ..... B22F 3/00; B22F 3/14; B22F 5/00; B22F 5/12; B22F 2003/248; B22F 2998/00; B22F 2998/10; B22F 2999/00; C22C 1/00; C22C 1/005; C22C 1/023; C22C 1/02; C22C 1/04; C22C 1/0433; C22C 19/00; C22C 19/03;
(Continued)

(56) References Cited

U.S. PATENT DOCUMENTS 5,309,748 A 5/1994 Jarrett et al.
5,400,633 A 3/1995 Segal et al.
(Continued)

OTHER PUBLICATIONS

Altan, Taylan Ngaile, Gracious Shen, Gangshu, Shirgaokar Manas. (2004). Cold and Hot Forging-Fundamentals and Applications—2.3 Types of Forging Processes. ASM International. pp. 8-15.*
(Continued)

*Primary Examiner* — Alexandra M Moore

(57) ABSTRACT

A thermal mechanical treatment method includes consolidating a powder by a severe plastic deformation process and ageing the consolidated powder at low temperature. The method may include cryomilling the powder before consolidating the powder by a severe plastic deformation process; hot isostatic pressing the consolidated powder into a dense powder before aging the consolidated powder; hot extruding the dense powder into a stock shape before aging the consolidated powder; hot-working the stock shape on a gyrating forge at a predetermined temperature before aging the consolidated powder; or heating the consolidated powder to a predetermined temperature, and maintaining the consolidated powder at the predetermined temperature for a predetermined time.

18 Claims, 13 Drawing Sheets

(51) Int. Cl.

| | |
|---|---|
| ***B22F 3/14*** | (2006.01) |
| *B22F 3/24* | (2006.01) |
| *C22C 19/05* | (2006.01) |
| *B22F 5/12* | (2006.01) |

(52) U.S. Cl.
CPC ..... *B22F 2003/248* (2013.01); *B22F 2998/10* (2013.01); *B22F 2999/00* (2013.01); *C22C 19/051* (2013.01); *C22C 2200/04* (2013.01)

(58) Field of Classification Search
CPC ..... C22C 19/05; C22C 19/051; C22C 19/052; C22C 19/053; C22C 19/055; C22C 19/056; C22C 19/057; C22C 38/00; C22C 38/08; C22C 38/18; C22C 38/22; C22C 38/40; C22C 38/44; C22C 45/00; C22C 45/008; C22C 45/006; C22C 45/04; C22C 2200/00; C22C 2200/02; C22C 2200/04; B21C 1/00; B21C 23/00; B21C 23/002; B21C 23/04; B21C 37/00; B21C 37/02; B21C 37/04; B21C 23/21; B30B 11/22
See application file for complete search history.

(56) References Cited

U.S. PATENT DOCUMENTS

| | | | | |
|---|---|---|---|---|
| 5,513,512 | A | 5/1996 | Segal et al. | |
| 5,702,543 | A * | 12/1997 | Palumbo | C21D 8/005 148/592 |
| 6,129,795 | A * | 10/2000 | Lehockey | C21D 1/785 148/608 |
| 6,197,129 | B1 | 3/2001 | Zhu et al. | |
| 6,399,215 | B1 | 6/2002 | Zhu et al. | |
| 6,883,359 | B1 | 4/2005 | Hartwig, Jr. | |
| 6,895,795 | B1 | 5/2005 | Chaudhury et al. | |
| 7,152,448 | B2 | 12/2006 | Zhu et al. | |
| 2004/0060620 | A1* | 4/2004 | Ma | C22F 1/00 148/577 |
| 2005/0126666 | A1 | 6/2005 | Zhu et al. | |
| 2005/0135959 | A1* | 6/2005 | Subramanian | C22C 27/04 419/19 |
| 2007/0151639 | A1* | 7/2007 | Oruganti | C22F 1/10 148/677 |
| 2009/0061229 | A1 | 3/2009 | Earthman et al. | |
| 2011/0272134 | A1 | 11/2011 | Roy et al. | |

OTHER PUBLICATIONS

Torrents, A., Yang, H. & Mohamed, F.A. Metall and Mat Trans A (2010) 41: 621. https://doi.org/10.1007/s11661-009-0147-0 (Year: 2010).*

El-sherik, A.M., Erb, U. Journal of Materials Science (1995) 30: 5743-5749. https://doi.org/10.1007/BF00356715. Print ISSN 0022-2461 Online ISSN 1573-4803 (Year: 1995).*

Champion, et al., "Near-Perfect Elastoplasticity in Pure Nanocrystalline Copper", Science, vol. 300, No. 5617, Apr. 11, 2003, pp. 310-311.

Chauhan, et al., "High-strain-rate superplasticity in bulk cryomilled ultra-fine-grained 5083 Al", Metallurgical and Materials Transactions A, vol. 37A, No. 9, Sep. 2006, pp. 2715-2725.

Cheng, et al., "Tensile properties of in situ consolidated nanocrystalline Cu", Acta Materialia, vol. 53, Issue 5, Mar. 2005, pp. 1521-1533.

Fullman, et al., "Formation of Annealing Twins During Grain Growth", Journal of Applied Physics, vol. 22, Issue 11, 1951, pp. 1350-1355.

Gindraux, et al., "New Concepts of Annealing—Twin Formation in Face-Centred Cubic Metals", Journal of the Institute of Metals, vol. 101, 1973, pp. 85-93.

Gleiter, H, "The formation of annealing twins", Acta Metallurgica, vol. 17, Issue 12, Dec. 1969, pp. 1421-1428.

Horton, et al., "Aspects of twinning and grain growth in high purity and commercially pure nickel", Materials Science and Engineering: A, vol. 203, Issues 1-2, Nov. 15, 1995, pp. 408-414.

Lu, et al., "Ultrahigh Strength and High Electrical Conductivity in Copper", Science, vol. 304, No. 5669, Apr. 16, 2004, pp. 422-426.

Ma, En, "Eight routes to improve the tensile ductility of bulk nanostructured metals and alloys", JOM, vol. 58, Issue 4, Apr. 2006, pp. 49-53.

Ma, En, "Watching the Nanograins Roll", Science, vol. 305, No. 5684, Jul. 30, 2004, pp. 623-624.

Maung, et al., "Thermal stability of cryomilled nanocrystalline aluminum containing diamantane nanoparticles", Journal of Materials Science, Vol0 46, Issue 21, Nov. 2011, pp. 6932-6940.

Meyers, et al., "Mechanical properties of nanocrystalline materials", Progress in Materials Science, vol. 51, Issue 4, May 2006, pp. 427-556.

Randle, et al., "Mechanism of twinning-induced grain boundary engineering in low stacking-fault energy materials", Acta Materialia, vol. 47, Issues 15-16, Nov. 1999, pp. 4187-4196.

Randle, et al., "The role of vicinal Σ3 boundaries and Σ9 boundaries in grain boundary engineering", Journal of Materials Science, vol. 40, Issue 12, Jun. 2005, pp. 3243-3246.

Randle, Valerie, "Twinning-related grain boundary engineering", Acta Materialia, vol. 52, Issue 14, Aug. 16, 2004, pp. 4067-4081.

Roy, et al., "Possible origin of superior corrosion resistance for electrodeposited nanocrystalline Ni", Scripta Materialia, vol. 59, Issue 3, Aug. 2008, pp. 305-308.

Roy, et al., "Thermal stability in bulk cryomilled ultrafine-grained 5083 Al alloy", Metallurgical and Materials Transactions A, vol. 37, Issue 3, Mar. 2006, pp. 721-730.

Sanders, et al., "Elastic and tensile behavior of nanocrystalline copper and palladium", Acta Materialia, vol. 45, Issue 10, Oct. 1997, pp. 4019-4025.

Shen, et al., "Tensile properties of copper with nano-scale twins", Scripta Materialia, vol. 52, Issue 10, May 2005, pp. 989-994.

Song, et al., "Improvement of the work hardening rate of ultrafine grained steels through second phase particles", Scripta Materialia, vol. 52, Issue 11, Jun. 2005, pp. 1075-1080.

Sun, et al., "Ultrafine composite microstructure in a bulk Ti alloy for high strength, strain hardening and tensile ductility", Acta Materialia, vol. 54, Issue 5, Mar. 2006, pp. 1349-1357.

Valiev, et al., "Achieving Exceptional Grain Refinement through Severe Plastic Deformation: New Approaches for Improving the Processing Technology", Metallurgical and Materials Transactions A, vol. 42, Issue 10, Oct. 2011, pp. 2942-2951.

Valiev, Ruslan, "Nanostructuring of metals by severe plastic deformation for advanced properties", Nature Materials, vol. 3, 2004, pp. 511-516.

Wang, et al., "High tensile ductility in a nanostructured metal", Letters to Nature, vol. 419, Oct. 31, 2002, pp. 912-915.

Wang, et al., "Temperature and strain rate effects on the strength and ductility of nanostructured copper", Applied Physics Letters, vol. 83, 2003, p. 3165.

Wang, et al., "Three strategies to achieve uniform tensile deformation in a nanostructured metal", Acta Materialia, vol. 52, Issue 6, Apr. 5, 2004, pp. 1699-1709.

Wu, et al., "γ→ ε martensite transformation and twinning deformation in fcc cobalt during surface mechanical attrition treatment", Scripta Materialia, vol. 52, Issue 7, Apr. 2005, pp. 547-551.

"Equal Channel Angular Pressing—a cost-effective consolidation route for titanium alloy semi-products?", Jan. 25, 2015, http://www.ipmd.net/articles/001578.html.

Ma, En, "Nanocrystalline materials: Controlling plastic instability", Nature Materials, vol. 2, 2003, pp. 7-8.

* cited by examiner (A)

(B)

(A)

(B)

(C)

THERMO-MECHANICAL TREATMENT OF MATERIALS

CROSS-REFERENCE TO RELATED APPLICATIONS

This application is a non-provisional patent application of U.S. Provisional Patent Application Ser. No. 61/806,781, filed on Mar. 29, 2013, and entitled: "THERMO-MECHANICAL TREATMENT OF MATERIALS HAVING LOW STACKING FAULT ENERGY." Accordingly, this non-provisional patent application claims priority to U.S. Provisional Patent Application Ser. No. 61/806,781 under 35 U.S.C. § 119(e). U.S. Provisional Patent Application Ser. No. 61/806,781 is hereby incorporated in its entirety.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir.

Well completion components are sometimes composed of metals such as various alloys of steel. Steel alloys are commonly produced using the four step process illustrated in FIG. 1. In Step 1, raw materials such as iron ore, limestone, coke, and others are collected and specific quantities of each constituent is measured and separated. Once measured, the specific quantity of each constituent is placed in a blast furnace, heated to high temperatures, and melted as seen in Step 2. After being melted and combined, the resulting mixture is placed in an oxygen furnace as shown in Step 3 to alter the chemical composition of the mixture. Finally, in Step 4, the mixture is extruded into rough shapes such as billets, slabs, sheets, or any other geometric shape.

The final products of the steel alloy production process illustrated in FIG. 1 are rough shapes which are subjected to additional processing. The additional processing includes thermal processes for example quenching, hardening, annealing or others to improve the mechanical properties of the alloy and physical processes such are thinning, rolling, machining, or others to change the shape of the rough shape.

Products produced using the process illustrated in FIG. 1 have well known limitations due to limitations of the base material. Improvement of the characteristic of the base materials may improve products produced using the base materials.

SUMMARY

In general, in one aspect, one or more embodiments relate to a thermal mechanical treatment method. The method includes consolidating a powder by a severe plastic deformation process and ageing the consolidated powder at low temperature.

Other aspects and advantages of the disclosure will be apparent from the following description and the appended claims.

BRIEF DESCRIPTION OF DRAWINGS

Certain embodiments of the disclosure will hereafter be described with reference to the accompanying drawings. It should be understood, however, that the accompanying drawings are not meant to limit the scope of various technologies described herein. The drawings show and describe various embodiments of the current disclosure.

DETAILED DESCRIPTION

Figure 1:
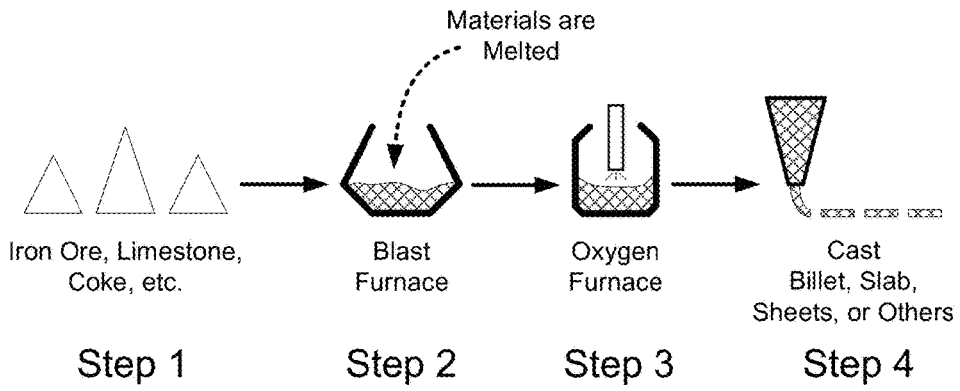
(Prior Art) FIGURE 1
FIG. 1 shows a well known steel alloy production process.

Specific embodiments will now be described in detail with reference to the accompanying figures. In the following description, numerous details are set forth to provide an understanding of the present disclosure. However, it will be understood by those skilled in the art that the embodiments of the present disclosure may be practiced without these details and that numerous variations or modifications from the described embodiments may be possible.

In the specification and appended claims: the terms "connect," "connection," "connected," "in connection with," and "connecting" are used to mean "in direct connection with" or "in connection with via one or more elements;" and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and downwardly," "upstream" and "downstream;" "above" and "below;" and other like terms indicating relative positions above or below a given point or element are used in this description to more clearly describe some embodiments of the disclosure.

Methods and processes to expand operating envelopes of oilfield alloys such as stainless steels, nickel alloys (for high pressure (HP) and high temperature (HT) applications) are disclosed. The methods and processes include low temperature ageing post processing of metallic materials, severe-plasticity processes such as Equi-channel angular processing (ECAP), and their derivatives with oilfield applications (1) to substantially raise alloy strength (triple in some cases) and correspondingly equipment pressure ratings (e.g., NiCrMo alloys in HPHT applications like sampling bottles), (2) to strengthen degradable alloys and enable their use for large-stage count fracturing in addition to tensile-loaded applications (3) to directly manufacture abrasion-subjected parts and increase their longevity (e.g., drill-stem stabilizers in deep and deviated wells). Processes disclosed herein result in greatly enhanced mechanical properties, and more controlled and superior operational limits because of the formation during processing of nanostructures. Unlike other processes, the disclosed processes are scalable, thereby realistic and appealing to demanding applications wherein current materials are pushed to their limits and have stopped offering design and application opportunities. The use of these processes is valuable to help distinguish products in HP, HT, multi-stage fracturing, and other areas.

A number of alternatives, often competing, are responsible for the plastic deformation and fracture of crystalline solids. The mechanism is determined by the kinetics of the alternatives occurring at the atomic scale, not limited to the motion of dislocations (coupled glide and climb), diffusion, grain boundary sliding (GBS), and twinning etc. In high pressure, high temperature (HPHT) sour environments, often encountered in downhole environments, corrosive fluids elevate the problem. Activity/fugacity of the hostile fluids, ions in solution, especially hydronium ions or protons (H3O+)—thus, the resulting pH, ion pairing, diffusion of H2 through the grain boundaries, triple junctions and matrix exaggerated by pressure and temperature affects the susceptibility of a stressed alloy exposed to such hostile environments.

Metals and alloys are suspected to be vulnerable to oxidation and corrosion as random high angle grain boundaries (GBs) could be attacked by various active species including oxygen and chemical dissolution. However, recent studies have shown that grain refined alloys with fine/ultrafine and nanocrystalline grains especially alloys with relatively low stacking fault energy (SFE) including nickel rich oilfield alloys with higher SFE and their nanocrystalline counterparts, processed through novel method of Thermo-mechanical treatment (TMT), for example, ECAP or other analogous severe plastic deformation (SPD) process, followed by low temperature ageing to increase volume fraction of low sigma coincidence lattice boundaries (Σ CSLs') can augment its strength, ductility and lead to enhancement of corrosion/oxidation resistance compared to its commercially available coarse grained counterparts. As such, the development techniques to re-engineer and process conventional alloys through TMT are both scientifically valuable (to chemistry) and technically relevant (to petrochemical and power industry, for example).

Generally, one or more embodiments may involve techniques of SPD, followed by low temperature ageing to augment mechanical properties of oilfield metallic materials (thus part rating), and enhance their response toward corrosion (including environmental cracking resistance, an effect especially evident in materials having low stacking fault energy (LSFE), also including nickel rich oilfield alloys—defined here as Thermo-mechanical treatment or TMT). While retaining the general dimensions of the treated alloy, ECAP is expected to: (1) increase residual stress; (2) refine grains and develop a nano to ultrafine grained microstructure—thus increasing (a) strength via "Hall Petch" strengthening (b) ductility—by abetting grain boundary sliding, thus possibly making the treated alloy high strain rate superplastic—resulting in better formability and working; (3) abet strain hardening through dislocation strengthening; (4) introducing (i) deformation twins (ii) annealing twins (though post processing heat treatment), thus increasing the volume fraction of low sigma coincidence lattice (low Σ CSLs') or coherent boundaries—improving both mechanical/environmental resistance of the treated alloy in hostile environments.

Figure 2:
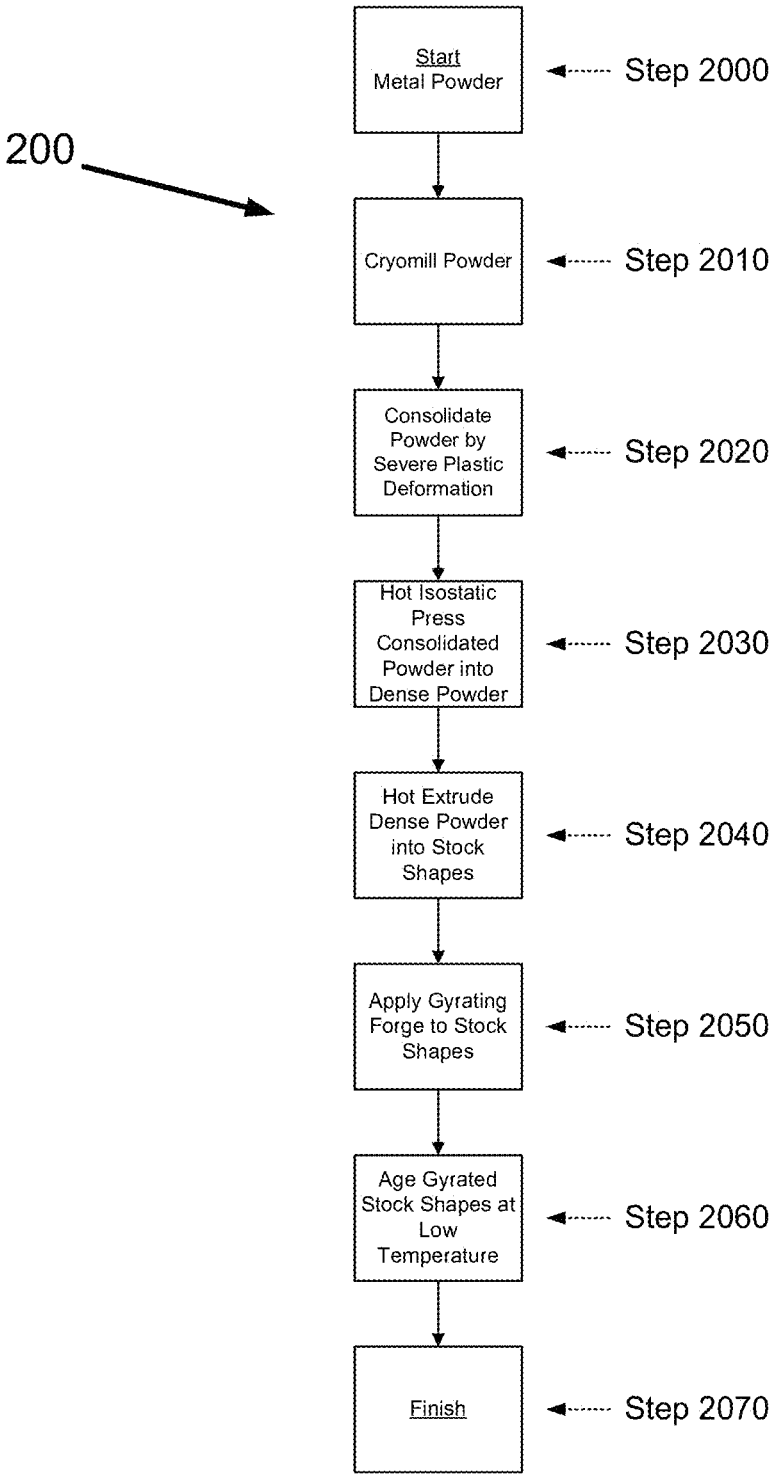
FIG. 2 shows a flow chart for a method in accordance with one or more embodiments.

FIG. 2 shows a method (200) in accordance with one or more embodiments. More specifically, FIG. 2 shows a block diagram of a method for applying a TMT to materials. The method starts at Step 2000 with a metal powder of any composition produced by any method. In one or more embodiments, the metal powder may be an alloy of steel and may include nickel and iron in its composition. In one or more embodiments, the metal powder may be a NiCrMo alloy. In one or more embodiments, the metal powder grain size is one selected from the group containing fine grained, ultrafine grained, and nanocrystalline grained. In one or more embodiments, the metal powder is an ingot metal (IM) product. In Step 2010, the metal powder may be refined in size by a cryomilling process. In Step 2020, the metal powder is consolidated by a severe plastic deformation process. In one or more embodiments, the severe plastic deformation process may be Equi-Channel Angular Processing (ECAP). Following consolidation, the consolidated powder may be Hot Isostatic Pressed (HIP) in Step 2030 to create a dense powder. After HIPing the dense powder may be hot extruded into a stock shape in Step 2040. In one or more embodiments, the stock shape may be one selected from the group containing a bar, rod, sheet, tube, or any other geometric shape. In one or more embodiments, the stock shape is a tube. In Step 2050, the stock shape may be subjected to a gyrating forge process. In Step 2060, the stock shape is aged at low temperature.

Figure 3:
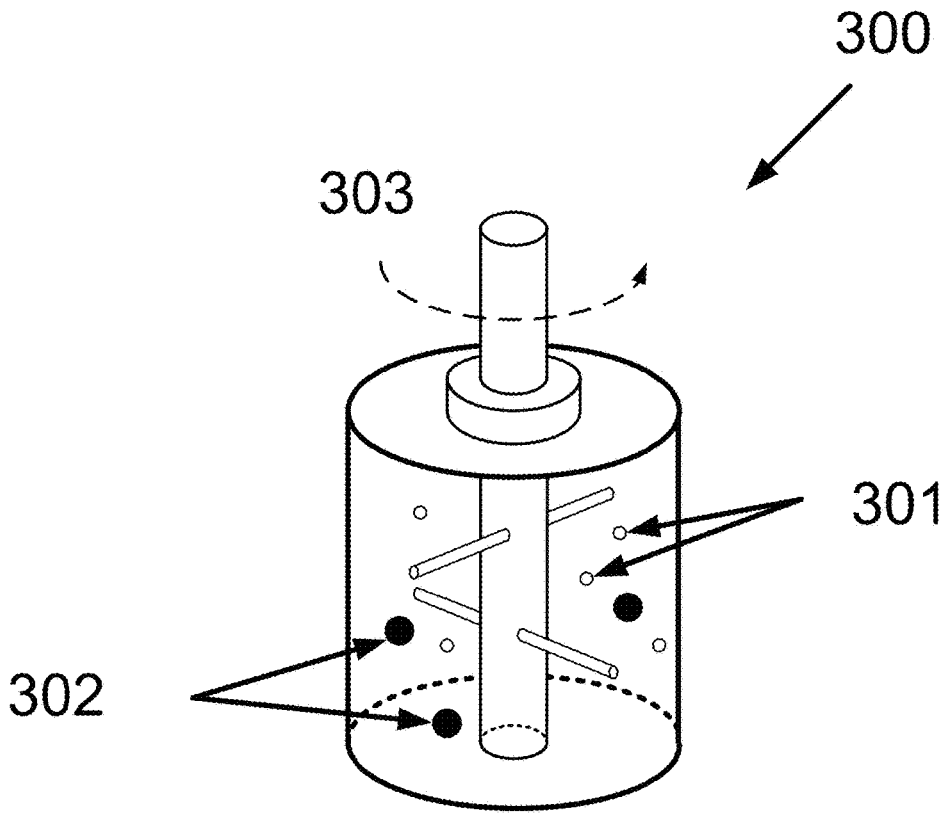
FIG. 3 shows a cryomilling process in accordance with one or more embodiments.

In accordance with one or more embodiments, FIG. 3 illustrates a cryomilling process. The cryomill (300) is a conventional ball mill apparatus that has been modified to operate while filled with liquid nitrogen. Cryomilling is performed by loading the cryomill (300) with a powder (301) to be cryomilled, grinding media (302), liquid nitrogen (not shown), and additives (not shown). In one or more embodiments, the powder to grinding media mass ratio loaded into the cryomill may be between approximately 25:1 and 35:1 (e.g., approximately 30:1 in some embodiments). In one or more embodiments, the additives may be stearic acid added at between approximately 0.1 to 0.3 weight percent ratio (e.g., approximately 0.2 weight percent ratio in some embodiments). In operation, the agitator rotates (303) and causes the grinding media (302) to impact the powder (301) which reduces the average particle size of the powder (301).

Figure 4:
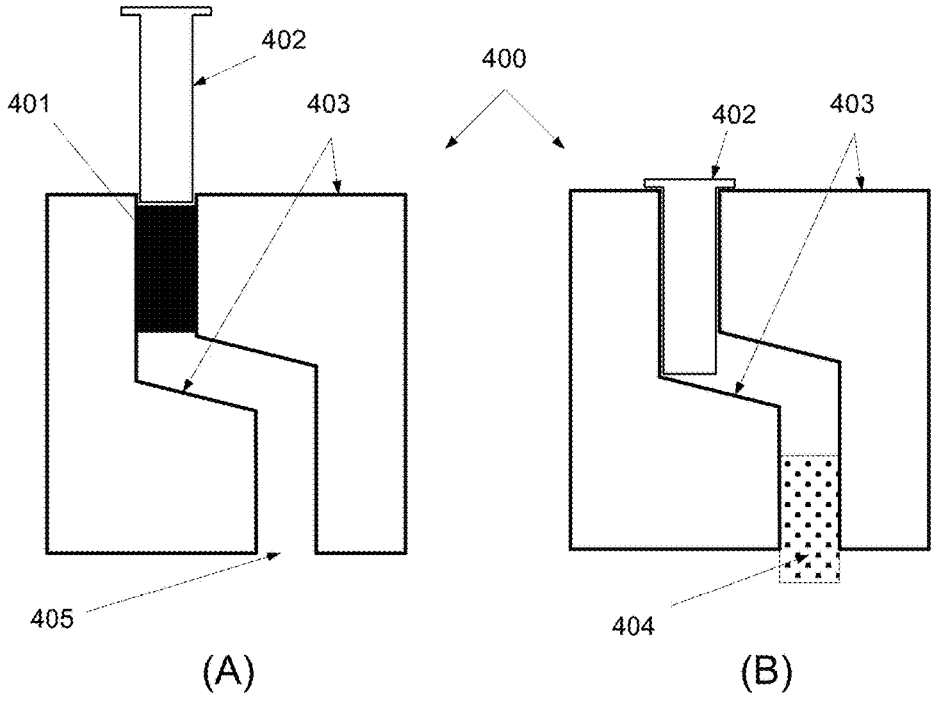
FIGS. 4(A) and (B) show an equi-channel angular press in accordance with one or more embodiments.
Figure 5:
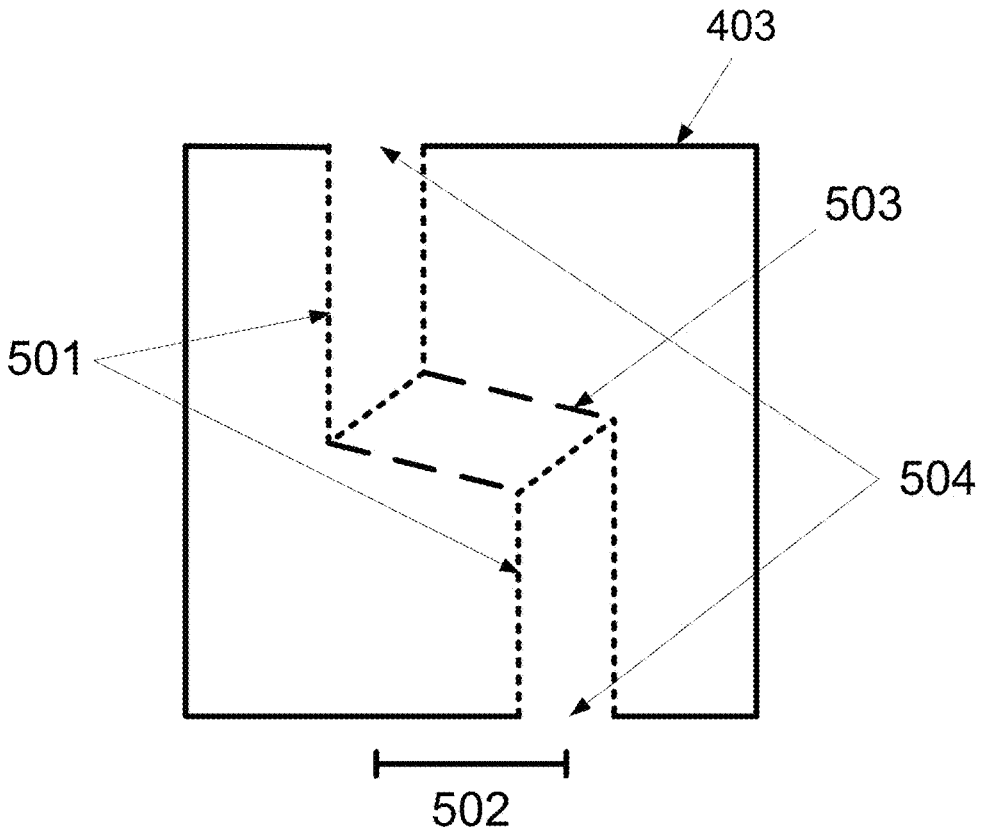
FIG. 5 shows additional details of an equi-channel angular press in accordance with one or more embodiments.

In accordance with one or more embodiments, FIG. 4(A), FIG. 4(B), and FIG. 5 illustrate an ECAP apparatus. The ECAP apparatus (400) includes a plunger (402) and die (403). The die (403) is a solid structure that includes a hollow passage with two openings (504). In one or more embodiments, the die (403) is composed of tool steel. The hollow passage is composed of two sections (501) that are parallel to each other and offset by a preset length (502). The two parallel sections (501) are further connected to each other by an additional section (503). The combination of the two sections (501) and the connecting section (503) form a single open passage from one location of the outside of the die (403) to another location on the outside of the die (403). In one or more embodiments, the two locations may be on opposite sides of the die. In other embodiments, the two locations may be on any side and even the same side.

In accordance with one or more embodiments, FIG. 4(A) and FIG. 4(B) illustrate an ECAP process. As shown in FIG. 4(A), powder (401) is loaded into one of the parallel sections (501) of the hollow passage. The plunger (402) is then positioned at the opening (405) of the hollow passage. The plunger (402) is then pushed into the hollow passage as shown in FIG. 4(B). Any method of pushing the plunger could be used such as a hydraulic cylinder (not shown). Pushing the plunger (402) forces the powder through both the parallel sections (501) and the additional section (503) which results in the powder undergoing severe plastic deformation. Void space in the powder is reduced, particle boundaries are realigned, and the process results in a consolidated powder (404).

Figure 6:
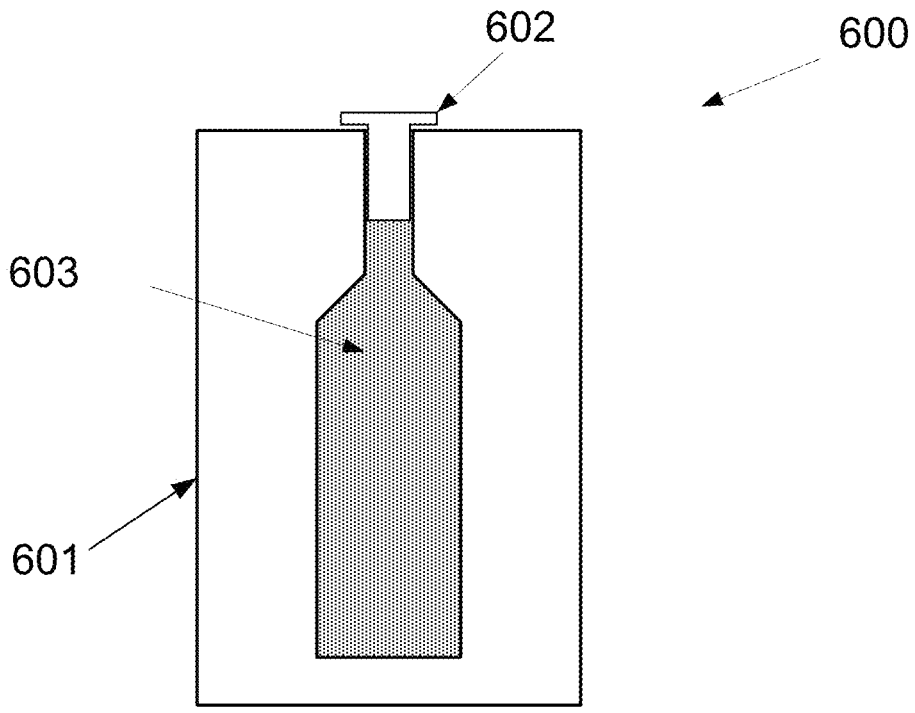
FIG. 6 shows a hot isostatic press in accordance with one or more embodiments.

In accordance with one or more embodiments, FIG. 6 illustrates a hot isostatic press apparatus. The hot isostatic press apparatus (600), as shown in FIG. 6, includes a die (601) and a plunger (602). The die contains a cavity. In one or more embodiments, the cavity may be any shape and include an opening. To hot isostatic press the powder the die (601) is heated to a preset temperature by a heating element (not shown). Once heated, the consolidated powder is placed in the die (601). A plunger (602) is then pushed into the cavity in the die. Any method of pushing the plunger could be used such as a hydraulic cylinder (not shown). The plunger (601) applies compressive force to the consolidated powder, increasing its density, and results in a dense powder (603).

Figure 7:
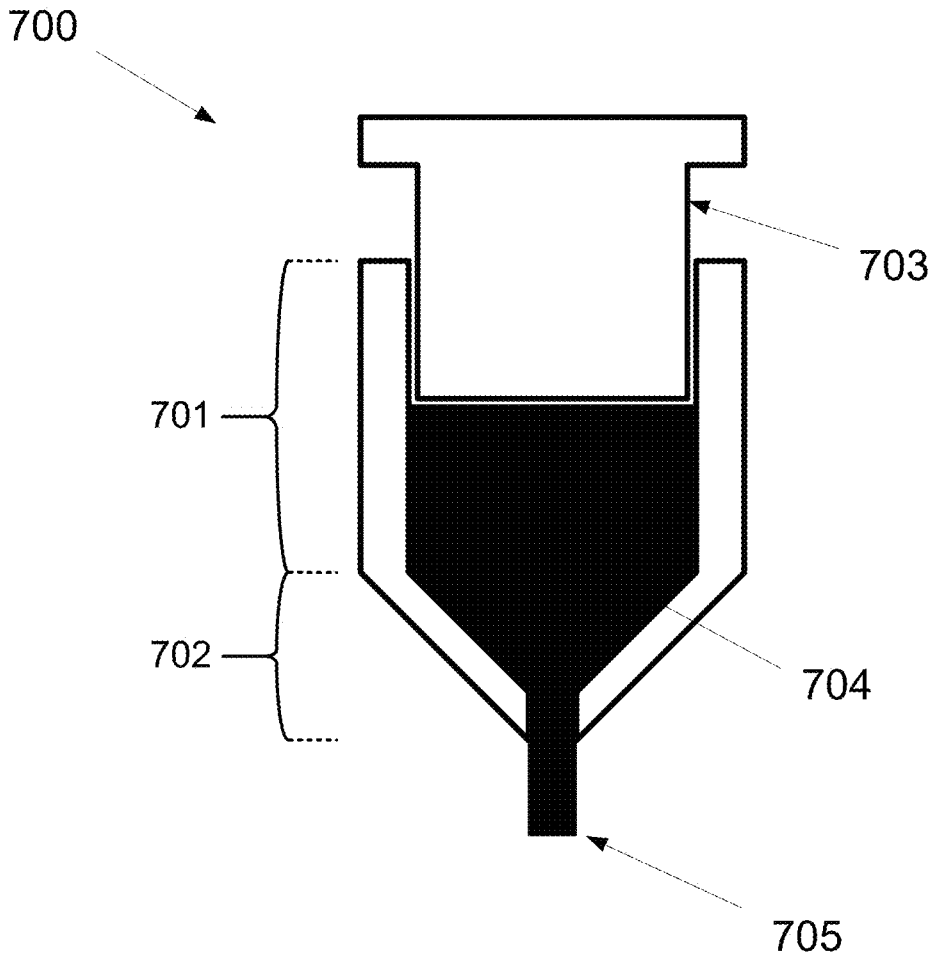
FIG. 7 shows a hot extruder in accordance with one or more embodiments.

In accordance with one or more embodiments, FIG. 7 illustrates a hot extrusion apparatus. As shown in FIG. 7, the hot extrusion apparatus (700) includes a heating body (701), extrusion nozzle (702), and a plunger (703). The heating body (701) contains a chamber to hold dense powder (704). The heating body (701) is further connected to an extrusion nozzle (702). In one or more embodiments, the extrusion nozzle (701) is detachable from the heating body (701) and replaceable with another extrusion nozzle. The extrusion nozzle (702) has an opening that is designed to extrude dense powder in the form of stock shapes (705). When loaded with dense powder (704) the heating body (701) is heated to a predetermined temperature and a plunger (703) is pressed into the chamber containing the dense powder (704) within the heating body (701) which causes dense powder (704) to be extruded from the extrusion nozzle (701) in the form of a stock shape (705).

Figure 8:
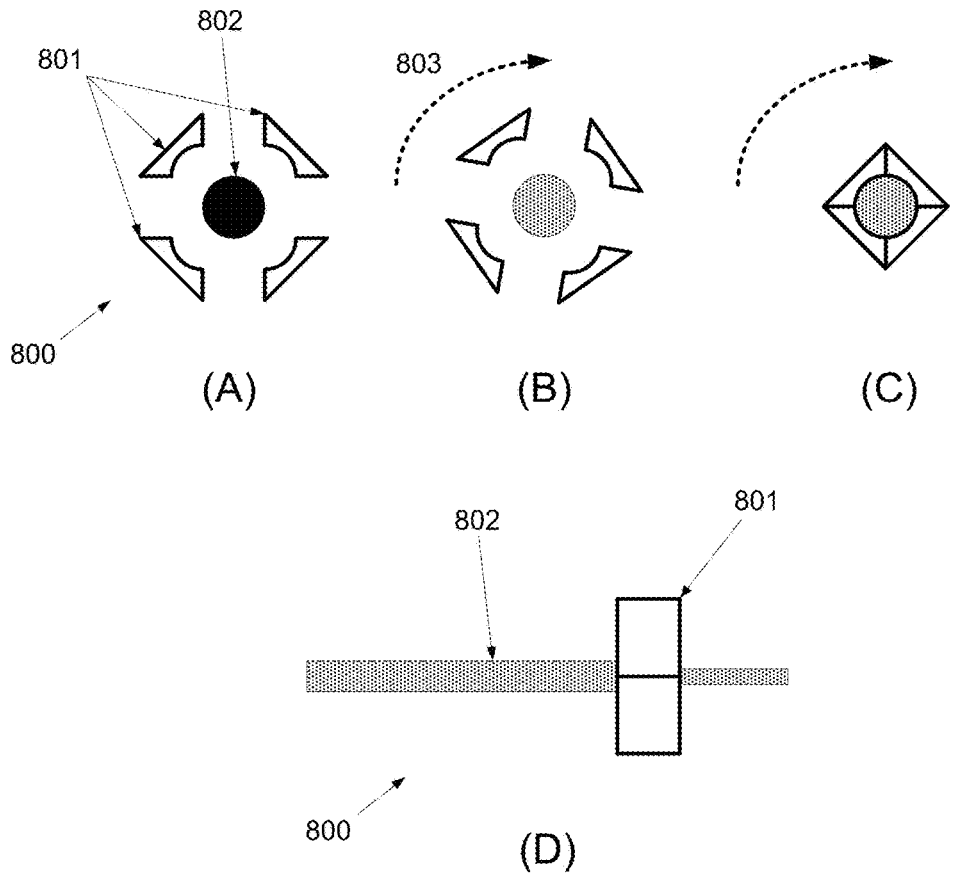
FIGS. 8 (A)-(D) shows a gyrating forge in accordance with one or more embodiments.

In accordance with one or more embodiments, FIG. 8(A) illustrates a cross-sectional view of a gyrating forge apparatus. The gyrating forge (800) is composed of a number of pieces that form a die (801). The die (801) can be rotated around a center point. Each piece of the die can be moved towards or away from the center point. A stock shape (802) to be operated on by the gyrating forge (800) is placed at the center point.

Operation of the gyrating forge is illustrated in FIG. 8(B), FIG. 8(C), and FIG. 8(D). In operation, the stock shape (802) located at the center point is heated (not shown) to a predetermined temperature. The pieces of the die (801) are then rotated around the stock shape. FIG. 8(B) shows the die (801) rotating in a clockwise direction (803), but the die (801) could rotate in a counterclockwise direction. Once the stock shape (802) is heated and the die (801) is rotating the die pieces (801) are moved toward the center point until the die pieces (801) make contact with one another as seen in FIG. 8(C). This causes compressive force to be applied to the body of the stock shape (802) and sheer force to be applied to the surface of the stock shape (802). Once the die (801) is fully closed, the die (801) is reopened, the stock shape (802) is fed ahead, and the process is repeated.

FIG. 8(D) illustrates a side view of a stock shape (802) that has been partially processed by the gyrating forge (800). To continue the gyrating forge process, the closed die (801) would be opened by moving the die pieces (801) away from the center point. The stock shape (802) would then be moved to the right and the die (801) would then be closed. The process is then continuously repeated until the stock shape is completely processed.

Figure 9:
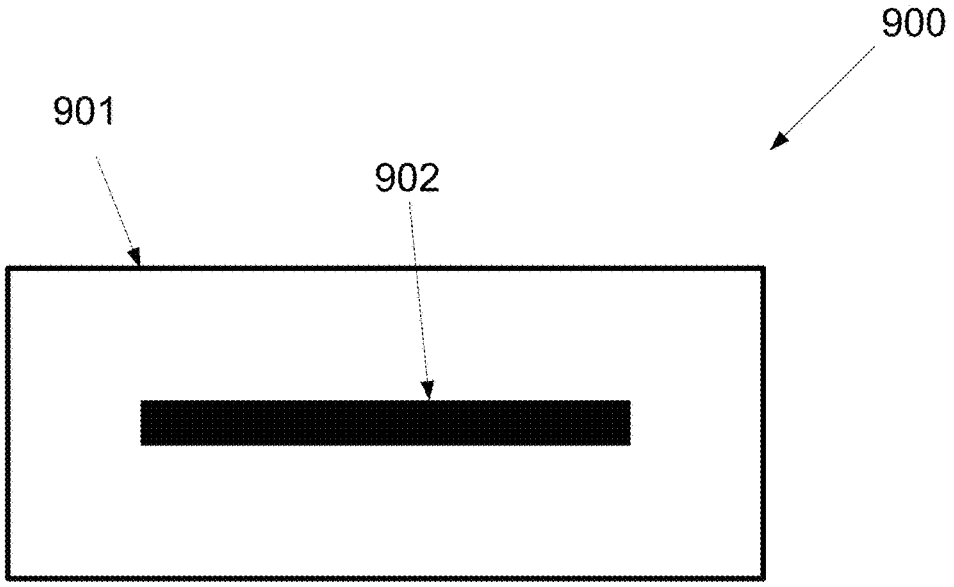
FIG. 9 shows a thermal treatment process in accordance with one or more embodiments.

In accordance with one or more embodiments, FIG. 9 illustrates a low temperature ageing process. The low temperature ageing process (900) is composed of heating the stock shape (902) to a predetermined temperature using a heating unit (901). In one of more embodiments, the heating unit (901) may be any apparatus capable of heating the stock shape (902). For example, the heating unit (901) may be an induction heater. In one of more embodiments, the heating unit (901) may be any apparatus capable of heating the stock shape (902) in a controlled atmosphere environment. For example, a tube furnace fitted with connections to accommodate a nitrogen or argon atmosphere may be used. In another example, a tube furnace fitted with connections to accommodate a reducing atmosphere such as between approximately 1-10% (e.g., approximately 5%) hydrogen and approximately 90-99% (e.g., approximately 95%) nitrogen may be used. In one or more embodiments, the predetermined temperature is below the recrystallization temperature of the material composing the stock shape (902). In one of more embodiments, the predetermined temperature is between approximately 1000 and approximately 1400 degrees Celsius.

Experiment 1

Figure 10:
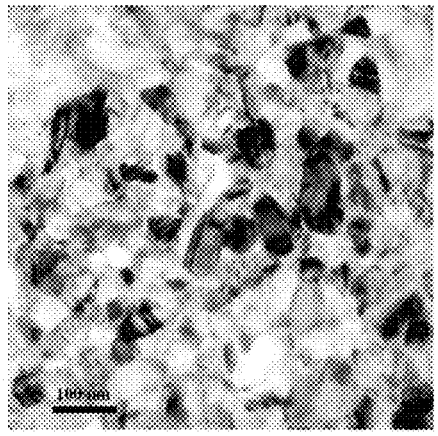
FIG. 10(A)-(B) show TEM analysis and a grain size measurement of a metal powder.
Figure 10:
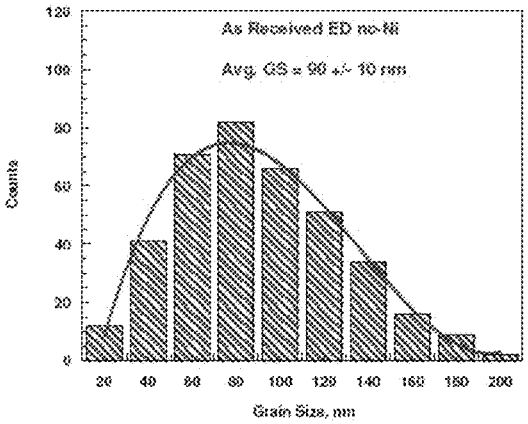

In accordance with one or more embodiments, an experiment to determine the effect of thermally treating nanocrystalline nickel and course grained nickel was carried out. High purity ED nc-Ni samples synthesized through pulse electrodeposition (PED) were obtained from Integran Technologies Inc., Toronto, Canada. Transmission electron microscopy (TEM) observations shown in FIG. 10(A) indicated that the average grain size measured from a sample size of several hundred grains using the linear intercept method was accorded to be of the order of approximately 90±10 nm. Grain size distribution as shown in FIG. 10(B).

A few widely spaced in-grown twins were evident from the TEM micrographs. To confirm and establish the mechanism of annealing twinning in ED nc-Ni, several specimens were subjected to isothermal annealing for different holding times at 573 K. It was observed that the twin density decreased with increasing holding time and that a maximum twin density of 6.51×106 mm−2 with an average twin lamellae thickness of 17.5 nm could be attained after approximately 30 minutes of annealing.

Figure 11:
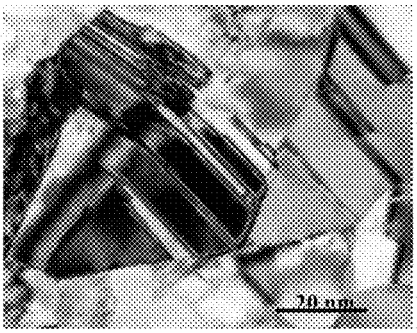
FIG. 11(A)-(C) show TEM analysis, grain size measurement, and lamella thickness measurement of a metal powder after thermal mechanical treatment in accordance with one or more embodiments.
Figure 11:
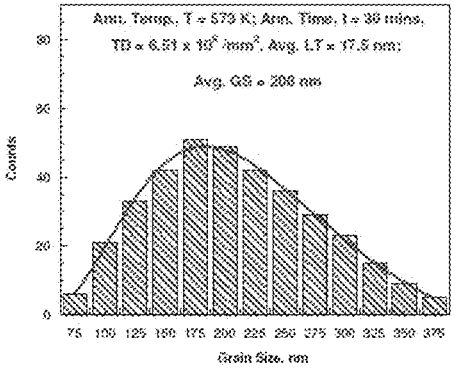
Figure 11:
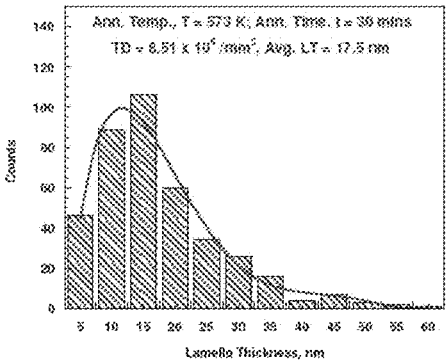

FIG. 11(A) shows a representative high magnification TEM micrograph of annealing twinned nc-Ni. The grain size and twin lamellae thickness distributions are shown in FIGS. 11(B) and (C). As observed in GBE materials, to substantiate the effect of annealing twins in enhancing salient mechanical properties, several tensile specimens of ED nc-Ni with the highest density of annealing twins were subjected to uniaxial tensile tests.

Figure 12:
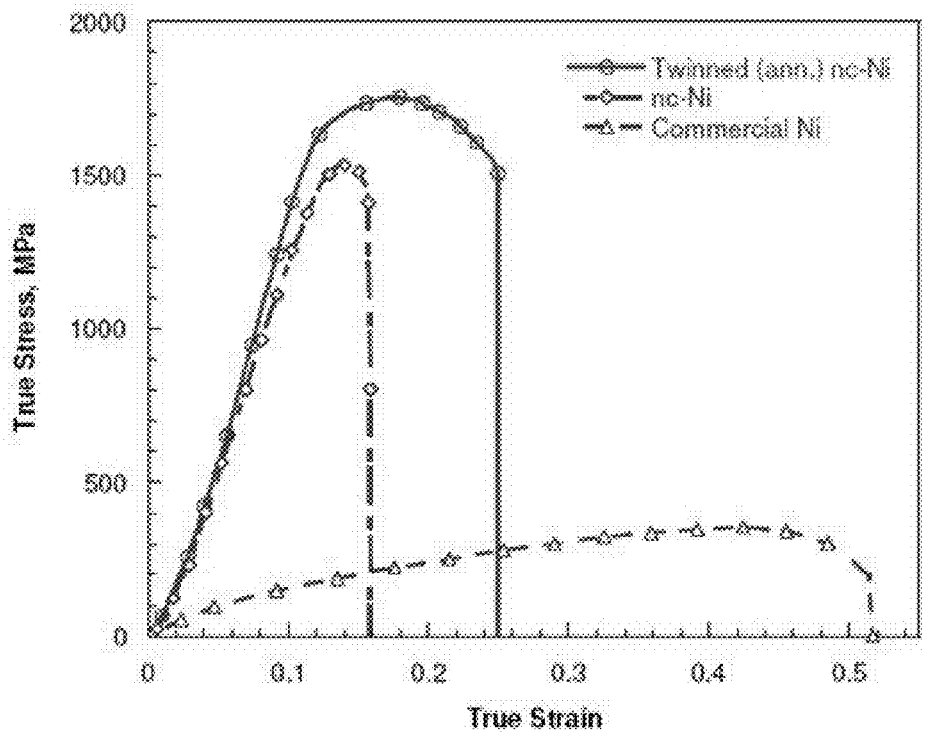
FIG. 12 shows a measured stress-strain relationship for a material after thermal mechanical treatment in accordance with one or more embodiments.

FIG. 12 shows representative true stress-strain curves for the ED nc-Ni and twinned nc-Ni specimens tested at 393 K with a strain rate of $10^{-3}$ $s^{-1}$.

Coarse grained (40 μm) polycrystalline Ni was tested under similar conditions for comparison and have been added in FIG. 12. It is interesting to note that both strength and ductility increase considerably with the introduction of annealing twins. The elongation to failure varied between 21% to 25% for the twinned nc-Ni, in contrast to a ductility of 10% to 15% for AR nc-Ni, which is approximately a 67% increase in ductility. It is to be noted that this data includes approximately 5% elastic strain, which even if discounted gives an impressive ductility of approximately 20% for twinned nc-Ni at such a high strength level.

A slight strain hardening as observed in case of nc-twinned material subjected to uniaxial tensile deformation was also observed. This is indicative of some dislocation accumulation during plastic straining prior to failure. Microhardness measurements on AR and twinned specimens agreed reasonably well with the tensile data.

Annealing twins are associated with a decrease of the overall interfacial energy or with the reorientation of grain boundaries so as to facilitate dislocation absorption and mobility during recrystallization. Though various explanations have been provided in rationale to the mechanisms by which annealing twins are formed and several models have been proposed, the phenomenon is still incompletely understood. Faults on {111} planes, growth accidents at growing grains or partial dislocations (and repulsion between them leading to lateral growth of faults) by growth accidents on {111} planes steps associated with grain boundary migration are the current thinking.

Although the Σ3 coherent twins as observed in the nc-Ni are not part of the intergrannular transport network, they do have an effect on the microstructure in terms of slip. Even in the presence of a common trace of glide planes, it has been observed that dislocation transmission through a coherent Σ3 is a direct transfer. The strengthening effect of twin boundaries acting as a strong barrier to dislocation motion has also been demonstrated in an in-situ TEM examination of the deformation process in nc-Cu specimen. Dislocation pile-ups and/or decomposition at the boundary occur, i.e., coherent Σ3s make at least as much contribution to hardening as do grain boundaries and so the twins are effective barriers to slip. Also, Σ3 coherent (annealing) twins are known to be immobile and resistant to attack/crack initiation.

Figure 13:
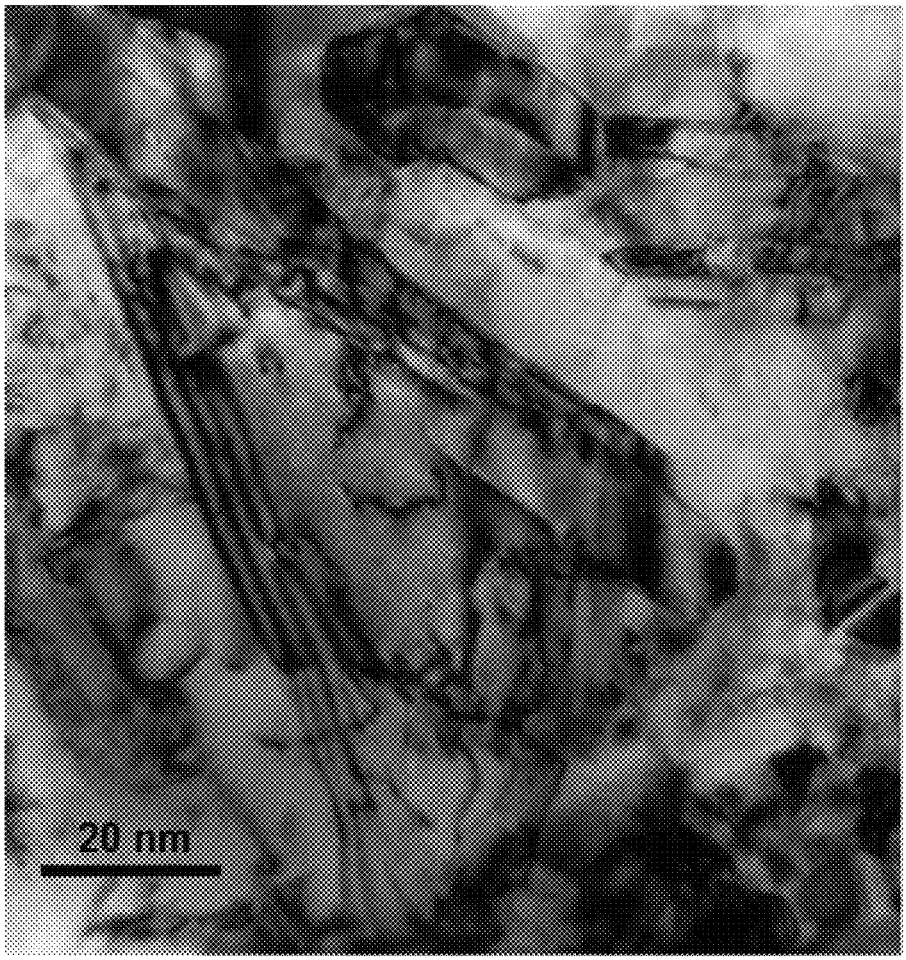
FIG. 13 shows sub-structural TEM analysis of a specimen in accordance with one or more embodiments.

Substructural TEM examination shown in FIG. 13 of the specimens subjected to tensile stress affirm the pivotal role played by the interaction of dislocations and the coherent Σ3 annealing twins in the deformation process.

It is known that, in most cases, dislocation glide is inhibited by twin boundaries, however, at times, dislocations can also pile-up and propagate across the twins if they undergo dislocation disassociation reactions. These stress concentrations at twin-slip band intersection, leading to further strengthening of nc-Ni. As such, the coherent Σ3 annealing twin boundary looks highly strained ('dirty') with stress field induced contrast under TEM observation. Also, many Shockley partials are detected at the post deformation twin boundaries which account for their deviation from planarity in contrast to those introduced through annealing.

It is to be noted that, where the proportion of Σ3 boundaries are high, interactions occur at their confluence leading to multiple twinning according to the rule concerning joining/dissociations of coincidence site lattices (CSLs):

$$\Sigma A+\Sigma B \leftrightarrows \Sigma(A\times B) \quad (1)$$

or $$\Sigma A+\Sigma B \leftrightarrows \Sigma(A/B) \quad (2)$$

(Equation 2 is applicable when A/B is an integer and A>B)

Hence, the meeting of two Σ3s leads to a Σ9 and if two boundaries at a triple junction are Σ3 and Σ9 then the third junction is either a Σ3 or a Σ27. However, it is to be noted that a few Σ27 boundaries are observed from actual experimental results. It is because generation of a Σ3, even if incoherent, is better than a Σ27 on the basis of lower energy. By the same argument, if a Σ9 encounters a Σ27, a Σ3 would be again generated, rather than a Σ243. This being the basis of the Σ3 regeneration model and grain boundary engineering (GBE): increase the proportion of Σ3s due to the attractive properties of Σ3 in dislocation absorption. Thus, a nanostructured material, as in this case, bulk ED nc-Ni, with a high volume fraction of triple junctions is seen to be permeated with a large volume fraction of coherent Σ3 boundaries which is beneficial to its mechanical properties. Increasing the already high volume fraction of low sigma CSL boundaries through engineering the nanostructure by introduction of annealing twins should enhance both strength and ductility, as well as salient properties of corrosion resistance as observed in GBE materials.

A high density of annealing twins was introduced in ED nc-Ni. Uniaxial tensile tests indicate that both the strength and ductility of the annealing twinned nc-Ni surpassed that of nc-Ni. The strength achieved by annealing twinned nc-Ni was almost five times that of commercial Ni, yet led to considerably more ductility. Results of the uniaxial tensile tests along with the detailed TEM/EBSD study paves way for a promising alternative to in-grown twin abetted enhancement of strength and ductility. Realization of reasonable ductility yet superseding the high strength of nanostructured materials by the introduction of annealing twins provides a rationale to the proposed route of thermo-mechanical processing of GBE.

While the above description is made with respect to a limited number of embodiments, those skilled in the art, having the benefit of this disclosure, will appreciate that other embodiments and variations can be devised which do not depart from the scope of the present disclosure.

What is claimed is:

1. A thermal mechanical treatment method, comprising:

consolidating a powder by a severe plastic deformation process wherein the powder comprises a nickel-based alloy; and aging the consolidated powder at a first temperature, wherein the first temperature is below a recrystallization temperature of the consolidated powder and is selected to be at least 0.05 $T_m$, wherein $T_m$ is the melting temperature of the powder in Kelvin, and wherein the aging occurs for a period of time that increases annealing twins density up to a maximum annealing twins density of the consolidated powder that increases the volume fraction of coherent low sigma coincidence lattice boundaries (Σ CSLs) to enhance strength and ductility of the consolidated powder.

2. The method of claim 1, further comprising:

before consolidating the powder, cryomilling the powder.

3. The method of claim 1, further comprising:

before aging the consolidated powder, hot isostatic pressing the consolidated powder into a dense powder.

4. The method of claim 1, wherein consolidating comprises hot extruding the powder into a stock shape.

5. The method of claim 4, further comprising:

before aging the consolidated powder, working the stock shape on a gyrating forge at a predetermined temperature.

6. The method of claim 4, wherein the stock shape is one of a solid cylinder, a hollow cylinder, and a sheet.

7. The method of claim 1, wherein aging the consolidated powder at the first temperature comprises:

heating the consolidated powder to the first temperature; and maintaining the consolidated powder at the first temperature for a predetermined time wherein the predetermined time is the period of time.

8. The method of claim 7, wherein the first temperature is between 573 and 1473 Kelvin.

9. The method of claim 1, wherein the severe plastic deformation process is equi-channel angular pressing.

10. The method of claim 1, wherein the powder comprises NiCrMo alloy.

11. The method of claim 1, wherein the powder grain size is one selected from the group containing fine grained, ultrafine grained, and nanocrystalline grained.

12. The method of claim 1 wherein the powder comprises electrodeposited powder.

13. The method of claim 12 wherein the powder comprises pulse electrodeposited powder.

14. The method of claim 1 wherein the powder comprises the nickel-based alloy as a pulse electrodeposited powder.

15. The method of claim 1 wherein the aged consolidated powder comprises a ductility greater than approximately 20 percent.

16. The method of claim 1 wherein the coherent low sigma coincidence lattice boundaries ($\Sigma$ CSLs) comprise coherent $\Sigma 3$ coincidence lattice boundaries.

17. The method of claim 1 wherein, for times greater than the period of time, the annealing twins density decreases.

18. The method of claim 1, wherein aging the consolidated powder at the first temperature comprises:

heating the consolidated powder to the first temperature; and maintaining the consolidated powder at the first temperature for a predetermined time wherein the predetermined time is the period of time and wherein the period of time is approximately 30 minutes.

* * * * *